US009498865B2

(12) United States Patent
Rizzo, Jr. et al.

(10) Patent No.: US 9,498,865 B2
(45) Date of Patent: Nov. 22, 2016

(54) SYSTEM AND METHODS FOR ROUGH GRINDING

(71) Applicant: UNITED TECHNOLOGIES CORPORATION, Farmington, CT (US)

(72) Inventors: John P. Rizzo, Jr., Vernon, CT (US); Micah Beckman, Middletown, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 31 days.

(21) Appl. No.: 14/577,632

(22) Filed: Dec. 19, 2014

(65) Prior Publication Data

US 2015/0183078 A1 Jul. 2, 2015

Related U.S. Application Data

(60) Provisional application No. 61/921,387, filed on Dec. 27, 2013.

(51) Int. Cl.

| | |
|---|---|
| ***B24B 53/04*** | (2012.01) |
| ***B24B 19/14*** | (2006.01) |
| ***B24B 53/047*** | (2006.01) |
| ***B24B 5/14*** | (2006.01) |

(52) U.S. Cl.

CPC ..... *B24B 19/14* (2013.01); *B24B 5/14* (2013.01); *B24B 53/04* (2013.01); *B24B 53/047* (2013.01)

(58) Field of Classification Search

CPC ... B24B 19/14; B24B 53/04; B24B 27/0076; B24B 49/18; B24B 49/183; B24B 53/07; B24B 49/16; B24B 53/00

USPC ..... 451/21, 56, 65, 66

See application file for complete search history.

(56) References Cited

U.S. PATENT DOCUMENTS

| | | | | | |
|---|---|---|---|---|---|
| 2,402,455 | A * | 6/1946 | Seyferth | B24B 53/04 | 125/11.17 |
| 2,660,836 | A * | 12/1953 | Green | B24B 17/025 | 451/212 |
| 2,680,392 | A * | 6/1954 | Gaved | B24B 19/14 | 29/889.7 |
| 2,887,828 | A * | 5/1959 | Martin | B24B 19/14 | 451/204 |
| 2,997,437 | A * | 8/1961 | Whitaker | B24B 19/14 | 204/209 |
| 3,928,943 | A * | 12/1975 | Wirz | B24B 49/186 | 451/21 |
| 3,940,675 | A * | 2/1976 | Schroeder | G05B 19/23 | 318/572 |
| 3,971,168 | A * | 7/1976 | Nishimura | B24B 49/10 | 451/1 |
| 4,051,830 | A * | 10/1977 | Gruber | B24B 53/053 | 125/11.01 |
| 4,214,191 | A * | 7/1980 | Watanabe | B23Q 17/09 | 318/561 |

(Continued)

*Primary Examiner* — George Nguyen

(74) *Attorney, Agent, or Firm* — Cantor Colburn LLP

(57) ABSTRACT

A system and methods are provided for grinding a workpiece. In one embodiment, a method includes controlling rotation of a workpiece, wherein the workpiece is rotated relative to a first axis, and controlling grinding of the workpiece by a first grinding tool to shape the workpiece, wherein the first grinding tool is rotated relative to a second axis. The method may also include controlling grinding of the workpiece by the grinding tool and rotation of the workpiece to provide grinding of the workpiece with a generally constant surface footage.

16 Claims, 4 Drawing Sheets

(56) References Cited

U.S. PATENT DOCUMENTS 4,441,281 A * 4/1984 Gordiski ..... B24B 49/00 318/571
4,810,945 A * 3/1989 Yoneda ..... G05B 19/232 318/561
4,930,265 A * 6/1990 Belthle ..... B23G 1/36 451/11
4,942,611 A * 7/1990 Kunugi ..... G05B 19/402 451/49
5,595,525 A * 1/1997 Hayashi ..... B24B 49/04 451/10
5,865,667 A * 2/1999 Rollier ..... B24B 1/00 451/11
6,062,209 A * 5/2000 Oishi ..... B23D 57/0046 125/16.01
6,200,200 B1 * 3/2001 Himmelsbach ..... B24B 19/12 451/195
6,217,420 B1 * 4/2001 Stocker ..... B23Q 3/186 257/E21.23
6,248,003 B1 * 6/2001 Hoshiya ..... B24B 53/00 451/173
6,273,785 B1 * 8/2001 Mulroy ..... B23Q 1/385 451/178
6,319,097 B1 * 11/2001 Coverdale ..... B24B 1/00 451/49
6,569,000 B1 * 5/2003 Mushardt ..... B24B 5/18 451/243
6,685,536 B1 * 2/2004 Junker ..... B24B 5/16 451/221
6,991,519 B2 * 1/2006 Laycock ..... B24B 5/01 451/10
7,435,157 B1 * 10/2008 Smarsh ..... B24B 5/18 451/11
8,784,156 B2 * 7/2014 Tano ..... B24B 1/00 451/10
2012/0190274 A1 * 7/2012 Ito ..... B23F 23/1218 451/11
2013/0118313 A1 * 5/2013 Mehrotra ..... B23C 3/32 76/108.6
2014/0154954 A1 * 6/2014 Hunt ..... B24B 19/14 451/11

* cited by examiner

SYSTEM AND METHODS FOR ROUGH GRINDING

CROSS-REFERENCE TO RELATED APPLICATIONS

This application claims priority to U.S. Provisional Application No. 61/921,387 filed on Dec. 27, 2013 and titled System and Methods for Grinding, the disclosure of which is hereby incorporated by reference in its entirety.

BACKGROUND

Turning is a machining process in which a cutting tool, typically a non-rotary tool bit, removes material from a workpiece while the workpiece rotates. Conventional methods of finishing and shaping aerospace components have employed turning to finish hardware. One processing limitation of turning is the length of processing time required to turn a piece. In addition, turning is less effective with hardened or temperature resistant materials. While there have been improvements to turning techniques, tool life and surface quality continues to be a concern. By way of example, turning may result in machining burrs or residual surface stress.

BRIEF SUMMARY OF THE EMBODIMENTS

Disclosed and claimed herein are a system and methods for grinding a workpiece. In one embodiment, a method for grinding a workpiece includes rotating a workpiece, wherein the workpiece is rotated relative to a first axis and controlling grinding of the workpiece by a first grinding tool to shape the workpiece, wherein the first grinding tool is rotated relative to a second axis. The method also includes controlling grinding of the workpiece by the grinding tool and rotation of the workpiece to provide grinding of the workpiece with a generally constant surface footage.

In one embodiment, a grinding system includes a machine tool configured to rotate a workpiece, wherein the workpiece is rotated relative to a first axis and a first grinding tool configured for grinding. The system also includes a control unit configured to control grinding of the workpiece by the first grinding tool to shape the workpiece, wherein the first grinding tool is rotated relative to a second axis, and controlling grinding of the workpiece by the grinding tool to provide a generally constant surface footage.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

One aspect of the disclosure relates to roughing and finishing a forged component to finished hardware using grinding. According to one embodiment, a system and methods are provided to control grinding of a workpiece. According to one embodiment, one or more grinding elements may be employed to grind and finish a rotating workpiece.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Figure 1:
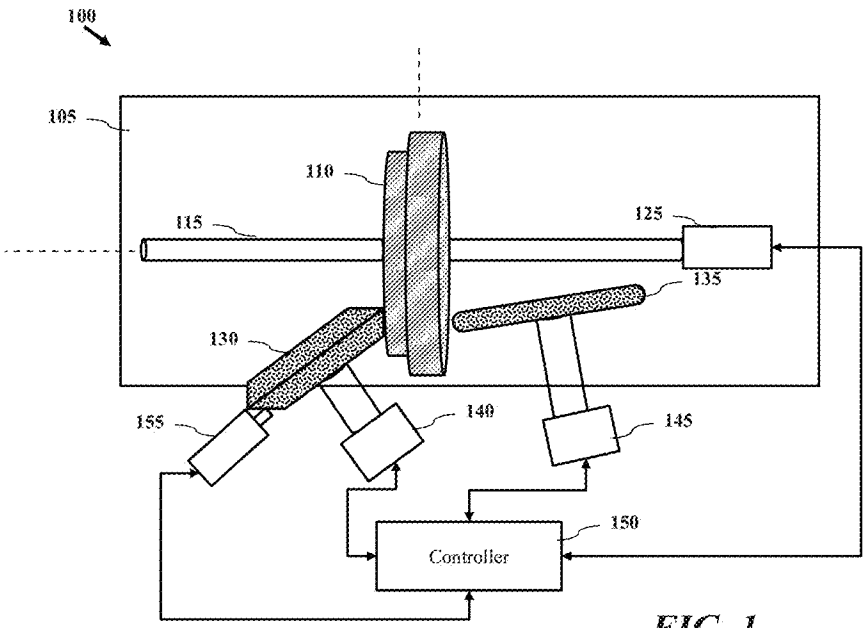
FIG. 1 depicts a simplified system diagram according to one or more embodiments.

Referring now to the figures, FIG. 1 depicts a simplified system diagram according to one or more embodiments. Grinding system 100 may be configured to provide grinding and finishing to create one or more components. According to one embodiment, grinding system 100 may include one or more grinding tools. In certain embodiments, system 100 may be configured to create turbine engine components, such as a high pressure turbine disk, high pressure compressor disk, side plate, cover plate, seal, impeller, gear, and powder metal alloy part in general, etc. System 100 may be configured for grinding one or more of standard alloys and powdered metal alloys (e.g., powder nickel alloys, etc.).

According to one embodiment, system 100 may include one or more elements to rough and finish a workpiece from a forged shape to a finished shape. System 100 includes machine tool 105 configured to rotate/spin workpiece 110. Machine tool 105 may include shaft 115 rotated by drive element 125. Drive element 125 may be configured to adjust the position of workpiece 110 in some embodiments. Controller 150 may be configured to control drive element 125. According to one embodiment, controller 150 may be configured to spin workpiece 110 and one or more grinding elements.

System 100 may include one or more grinding elements, such as grinding tool 130 and disc grinding tool 135. Grinding tool 130 may be rotated by drive unit 140. Drive unit 140 may be configured to control the rotational speed and plunge speed for grinding tool 130. Similarly, disc grinding tool 135 may be rotated by drive unit 145. According to one embodiment, system 100 may be configured to allow for one or more of outside diameter grinding, inside diameter grinding, plunge grinding, and cylindrical grinding of one or more forged components. Grinding tools of system 100 may include conventional or super abrasives in vitrified, resin, plated, or brazed bonds. According to one embodiment, grinding tools may be configured for grinding with material removal up to 20 cubic inches per minute or more.

In one embodiment, system 100 may be configured to rough grind a workpiece with one grinding element. According to another embodiment, system 100 may include grinding a workpiece with a grinding element, such as grinding tool 130, and a finish grinding element, such as grinding tool 135. Although grinding tools 130 and 135 are shown in a particular orientation and with a particular shape in FIG. 1, it should be appreciated that the grinding tools may be tilted, repositioned and/or conform to different geometries. Tilting, positioning, and repositioning may be performed during grinding of a workpiece according to one or more embodiments. System 100 may include one or more components for adjusting the position of grinding tools 130 and 135. In certain embodiments, system 100 may be configured to rough grind a workpiece using one or more of tools, such as tools 130 and 135. In other embodiments, a grinding tool, such as grinding tool 130, may be employed for rough grinding. As used herein, rough grinding can include material removal and surface finishing for the workpiece.

According to another embodiment, system 100 may include dressing tool 155. Dressing tool 155 may be configured to true the surface of grinding tool 130. In certain embodiments, dressing tool 155 may be configured to shape the surface of grinding tool 130 prior to, or while, grinding a workpiece. Dressing tool 155 may be configured to true the surface of grinding tool 130 by removing particles from the surface of the tool. Similarly, dressing tool 155 may be applied to grinding tool 130 to expose a fresh surface of the tool and/or clean the surface of the tool. By dressing the surface of grinding tool 130, dressing tool 155 may minimize vibration and improve surface finish of grinding tool 130. Dressing tool 155 may be a diamond tool or other dressing tool that is known to those of ordinary skill in the art.

Figure 2B:
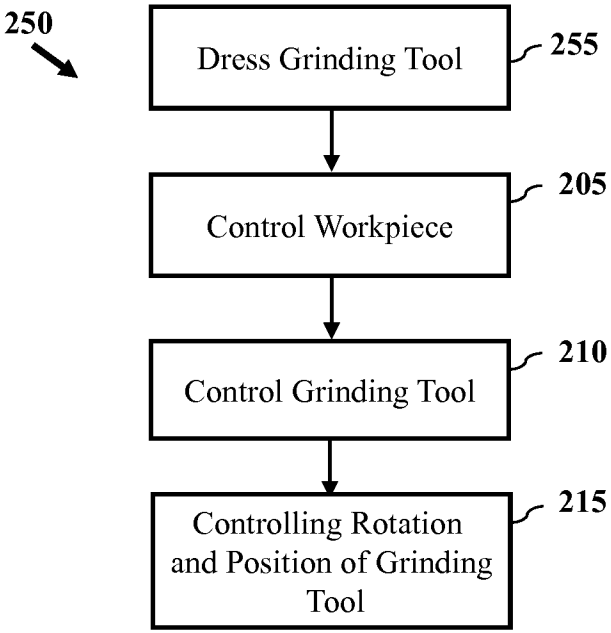
FIG. 2B depicts a method for grinding according to one or more embodiments.
Figure 2A:
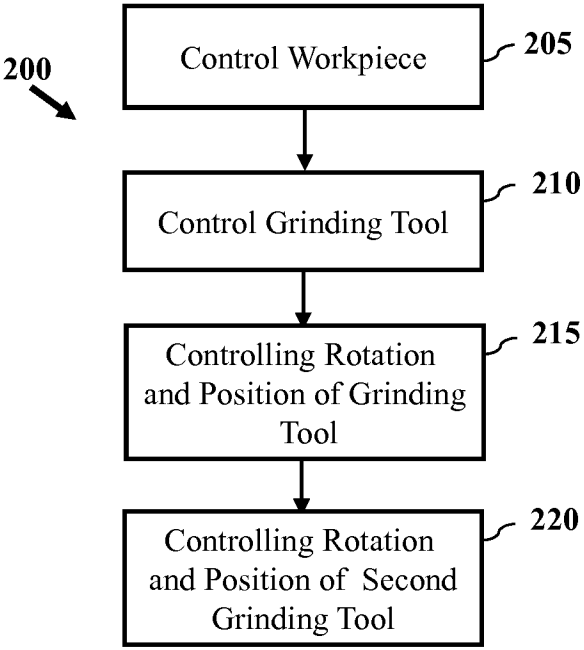
FIG. 2A depicts a method for grinding according to one or more embodiments.

FIG. 2A is a process flow depicting a method for grinding according to one or more embodiments. Process 200 may be employed by a machine for grinding, such as the system of FIG. 1. Process 200 may be configured for grinding powdered metal alloys, including powder nickel alloys. Process 200 may be initiated by rotating, or controlling the rotation of, a workpiece, wherein the workpiece is rotated relative to a first axis at block 205. A workpiece may be a forged shape or component. In one embodiment, the workpiece may be rotated or spun continuously or intermittently during grinding. Rotation speed of the workpiece may be based on providing a generally constant surface footage with a grinding tool. The workpiece may be a component for one or more of a high pressure turbine disk, high pressure compressor disk, side plate, cover plate, seal, impeller, gear, and/or any powder metal part, or alloy part in general. The workpiece rotation axis, or first axis, is perpendicular to a central axis of the workpiece. The workpiece rotation axis, may be along a central axis of the workpiece.

At block 210, grinding of the workpiece by a first grinding tool is controlled to shape the workpiece. The first grinding tool is rotated relative to a second axis. Grinding at block 210 may be performed by one of a grinding wheel or other tool, such as a superabrasive grinding wheel. The grinding tool may include super abrasives, vitrified materials, or resin bonded materials. The grinding tool may include one or more grinding surfaces. Controlling grinding of the workpiece by a first grinding tool may include controlling the rotational angle, speed, and position of the grinding tool.

At block 215, workpiece grinding by the grinding tool and rotation of the workpiece may be controlled to provide grinding of the workpiece with a generally constant surface footage. According to one embodiment, surface footage may be the distance in feet that the workpiece surface or grinding tool travels per unit of time (e.g., minute), such as surface feet per minute (sfm). In some cases, the grinding tool diameter may change during grinding. For example, the grinding tool may be worn and/or application of a dressing tool may reduce the surface diameter of the tool. Accordingly, the grinding tool may be positioned or repositioned relative to a workpiece and/or the rotational speed of the grinding element and/or workpiece may be modified to provide a generally constant surface footage.

Controlling grinding may include control of a finishing grinding tool rotating about a third axis. In certain embodiments, process 200 may include controlling a dressing tool for the grinding tool applied to one or more grinding surfaces of the grinding tool. FIG. 2B depicts a method for grinding according to one or more embodiments. Process 250 includes elements similar to those described above in FIG. 2A, wherein the description of blocks with like reference numbers is incorporated by reference. Process 250 includes dressing the grinding tool at block 255. Dressing the grinding tool at block 255 may allow for the surface of the grinding tool to be trued, cleaned and/or shaped according to one or more embodiments.

According to one embodiment, process 200 or 250 may provide machining with a faster rate of material removal. According to another embodiment, process 200 or 250 may utilize grinding as a replacement for a turning process. By way of example, process 200 or 250 may be employed to provide grinding with material removal up to 20 cubic inches a minute or more. In that fashion, process 200 or 250 may remove material faster than turning or milling. In some instances, turning may only allow material removal of 5 cubic inches a minute. Process 200 or 250 may be employed for at least one of surface plunging and/or traverse grinding and may include employ plated and vitrified wheels.

Figure 3:
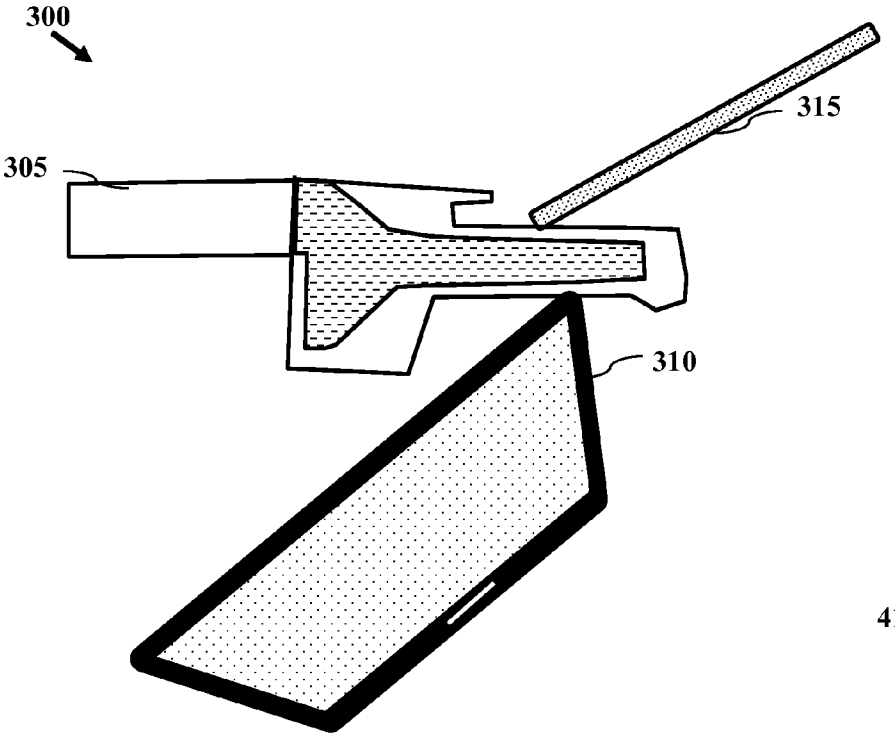
FIG. 3 depicts a graphical representation of grinding and finish grinding according to one or more embodiments.

FIG. 3 depicts a graphical representation of grinding and finish grinding according to one or more embodiments. According to one embodiment, grinding may include application of a plurality of grinding tools to a workpiece, such as grinding by disc grinder 315 and angle wheel grinder 310 for grinding disc component 305. Disc component 305 may be a turbine disk. According to one embodiment, disc grinder 315 and angle wheel grinder 310 may be applied to rotating workpiece at the same time to form component 305. Disc grinder 315 may provide finish grinding for component 305. Angle wheel grinder 310 may be applied for grinding of component 305.

Figure 4:
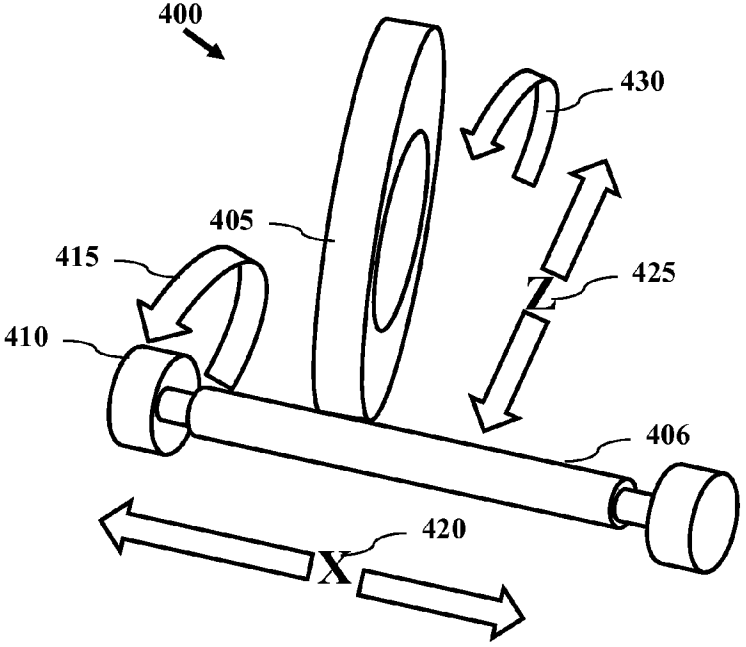
FIG. 4 depicts a graphical representation of finish grinding according to one or more embodiments.

FIG. 4 depicts a graphical representation of finish grinding according to one or more embodiments. According to one embodiment, grinding may relate to finish grinding of a component including outside diameter grinding of a cylindrical workpiece. FIG. 4 illustrates a grinding wheel 405 and workpiece 406. According to one embodiment, workpiece 406 may be rotated by a machine element 410 relative the central axis of the workpiece, as shown by direction 415. Finish grinding may then include controlling one or more of the horizontal position of grinding wheel 405 (shown as 420, the "X" direction), the radial distance of grinding wheel 405 (shown as 425, the "Z" direction), and the rotational speed/surface footage of grinding wheel 405 (shown as 430, the "X" direction). Finish grinding of a cylindrical element may include peel grinding in one or more embodiments.

Figure 5:
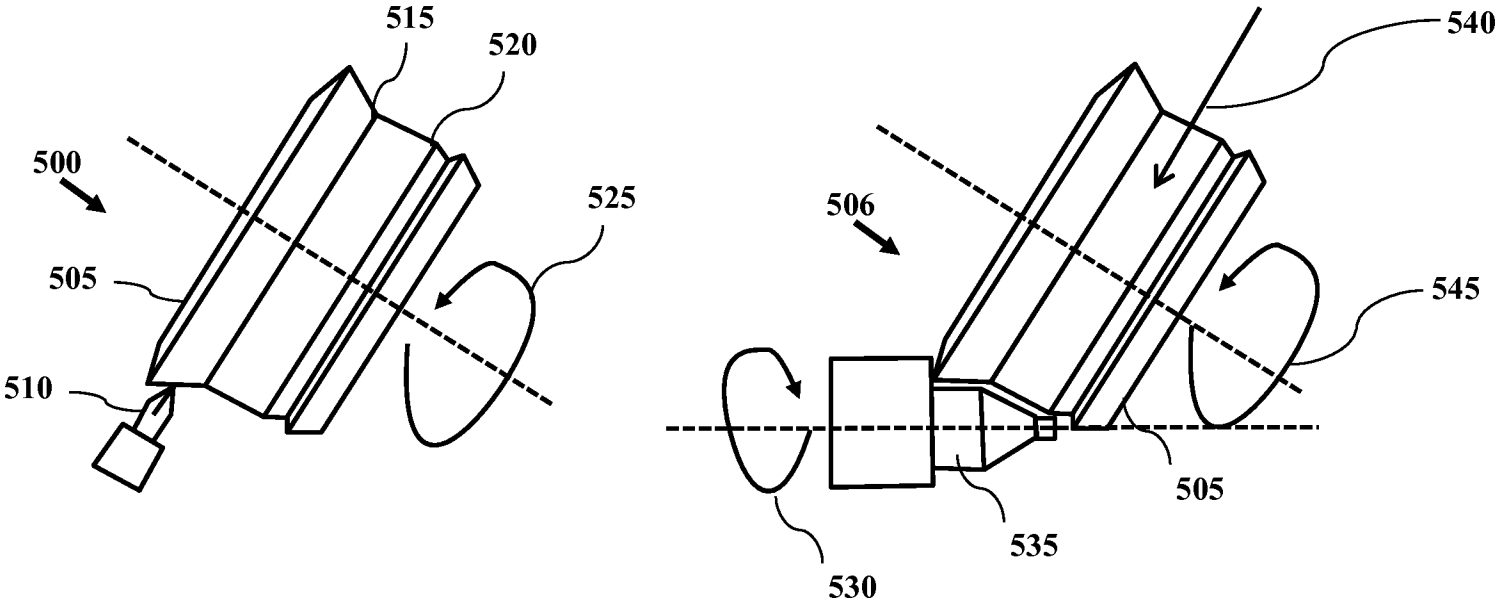
FIG. 5 depicts a graphical representation of plunge grinding according to one or more embodiments.

FIG. 5 depicts a graphical representation of plunge grinding according to one or more embodiments. According to one embodiment, grinding of a workpiece may be based on dressing grinding wheel and plunge grinding a workpiece with the dressed tool. In FIG. 5, grinding tool dressing is shown as 500. Grinding tool 505 may be a grinding wheel that is trued, cleaned and/or shaped by dressing tool 510 which may be a blade diamond tool. Dressing may form one or more surfaces or edges on the grinding tool 500, such as knife edge 515 and groove 520, or any other edge shape. According to one embodiment, knife edge 515 and groove 520 may be formed or dressed by rotations of workpiece 505 in direction 525 while applying dressing tool 510. Dressing of grinding tool 505 may be based on a desired form for a workpiece. Grinding tool 505 may be employed for grinding shown as 506, following dressing or similarly during dressing of the grinding tool. Grinding 506 may be plunge grinding of grinding tool 505 to workpiece 535. According to one embodiment, workpiece 535 (e.g., the part) may be rotating in direction 530 while grinding tool 505 is rotating in direction 545 and applied in direction 540 to the workpiece 535.

While this disclosure has been particularly shown and described with references to exemplary embodiments thereof, it will be understood by those skilled in the art that various changes in form and details may be made therein without departing from the scope of the claimed embodiments.

What is claimed is:

1. A method for grinding a workpiece, the method comprising the acts of:

rotating a workpiece, wherein the workpiece is rotated relative to a first axis;

controlling grinding of the workpiece by a first grinding tool to shape the workpiece, wherein the first grinding tool is rotated relative to a second axis; and controlling grinding of the workpiece by the grinding tool while maintaining a generally constant surface footage, wherein controlling grinding of the workpiece by a first grinding tool includes controlling the rotational angle and position of the grinding tool.

2. The method of claim 1, wherein the workpiece is at least one of a high pressure turbine disk, high pressure compressor disk, side plate, cover plate, seal, impeller, gear, powder metal part, and alloy part.

3. The method of claim 1, wherein the first axis is perpendicular to a central axis of the workpiece.

4. The method of claim 1, wherein the first axis is along a central axis of the workpiece.

5. The method of claim 1, wherein the grinding tool is one of a grinding wheel, superabrasive tool, and wherein the grinding tool has one or more grinding surfaces.

6. The method of claim 1, further comprising a finishing grinding tool, wherein the finishing grinding tool is controlled to rotates about a third axis.

7. The method of claim 1, wherein further comprising controlling a dressing tool for the grinding tool, wherein the dressing tool is applied to the grinding surface of the grinding tool.

8. The method of claim 1, wherein the workpiece is a powdered alloy.

9. A grinding system comprising:

a machine tool configured to control rotation of a workpiece, wherein the workpiece is rotated relative to a first axis;

a first grinding tool configured for grinding; and a control unit configured to control grinding of the workpiece by the first grinding tool to shape the workpiece, wherein the first grinding tool is rotated relative to a second axis; and controlling grinding of the workpiece by the grinding tool to provide a generally constant surface footage, wherein controlling grinding of the workpiece by a first grinding tool includes controlling the rotational angle and position of the grinding tool.

10. The system of claim 9, wherein the workpiece is at least one of a high pressure turbine disk, high pressure compressor disk, side plate, cover plate, seal, impeller, gear, powder metal part and alloy part.

11. The system of claim 9, wherein the first axis is perpendicular to a central axis of the workpiece.

12. The system of claim 9, wherein the first axis is along a central axis of the workpiece.

13. The system of claim 9, wherein the grinding tool is one of a grinding wheel, superabrasive tool, and wherein the grinding tool has one or more grinding surfaces.

14. The system of claim 9, further comprising a finishing grinding tool, wherein the finishing grinding tool is controlled to rotates about a third axis.

15. The system of claim 9, wherein further comprising controlling a dressing tool for the grinding tool, wherein the dress tool is applied to the grinding surface of the grinding tool.

16. The system of claim 9, wherein the workpiece is a powdered alloy.

* * * * *